United States Patent [19]

Adams

[11] Patent Number: 4,542,826

[45] Date of Patent: Sep. 24, 1985

[54] FLEXIBLE BAG TYPE BEVERAGE CAN CARRIER

[76] Inventor: Mark S. Adams, Indian Trail, R.F.D. 1, New Milford, Conn. 06776

[21] Appl. No.: 567,166

[22] Filed: Dec. 30, 1983

[51] Int. Cl.[4] ..... B65D 5/36; B65D 33/02

[52] U.S. Cl. ..... 206/427; 206/430; 383/38; 383/6

[58] Field of Search ..... 206/427, 430; 383/38, 383/106, 104, 6

[56] References Cited

U.S. PATENT DOCUMENTS

| | | | |
|---|---|---|---|
| 1,850,714 | 3/1932 | Gaylord | 206/430 |
| 1,975,428 | 10/1934 | John | 206/430 |
| 1,983,418 | 12/1934 | Thurmer | 383/38 |
| 2,057,748 | 10/1936 | Smith | 383/104 |
| 2,874,869 | 2/1959 | Hennessey | 206/430 |
| 3,263,806 | 8/1966 | Ring | 206/427 |
| 4,236,638 | 12/1980 | Griffith | 206/427 |
| 4,290,525 | 9/1981 | Sisson | 206/427 |
| 4,304,332 | 12/1981 | Danti | 206/427 |

FOREIGN PATENT DOCUMENTS

| | | | |
|---|---|---|---|
| 855062 | 11/1970 | Canada | 206/427 |
| 2056139 | 5/1972 | Fed. Rep. of Germany | 383/6 |
| 985824 | 3/1965 | United Kingdom | 206/430 |

*Primary Examiner*—William T. Dixon, Jr.
*Assistant Examiner*—Brenda J. Ehrhardt
*Attorney, Agent, or Firm*—Harvey B. Jacobson

[57] ABSTRACT

A carrier for beverage containers and more particularly a carrier in the form of a flexible bag which can be collapsed from an extended position during use to a more compact condition for storage and transport with the bag adapted to receive a plurality of vertically disposed rows of empty beverage cans to facilitate such beverage cans being returned to their point of purchase in order to obtain a refund of a deposit paid when the beverages were purchased. The bag is generally rectangular in configuration and provided with carrying handles on opposite sides thereof with the peripheral wall of the bag being transparent to enable observation of the cans disposed therein with the interior of the bag being divided into a plurality of vertical compartments by a plurality of pivotally connected dividers with the bottom of the bag including a rigid insert to provide a flat bottom to provide a stable unit when in extended condition. While the carrier is especially constructed for use with beverage cans, it can also be used with returnable bottles.

1 Claim, 4 Drawing Figures

FLEXIBLE BAG TYPE BEVERAGE CAN CARRIER

BACKGROUND OF THE INVENTION

1. Field of the Invention

The present invention generally relates to a hand-carried carrier in the form of a flexible, open topped bag including oppositely disposed, parallel side and end walls interconnected by a bottom all being constructed of flexible, transparent material, such as vinyl or the like and including a bottom panel, dividers and end panels all of substantially rigid material to retain the carrier in extending position wherein a plurality of vertically elongated compartments for a plurality of vertically stacked cans, bottles or other containers is provided to facilitate the carrying of a plurality of such containers with minimum difficulty.

2. Description of the Prior Art

Beverage bottles have been provided with foldable cardboard carriers and the like by which a predetermined number of bottles, such as six bottles, can be easily carried. Such carriers are normally supplied by the bottler and accompany the bottles when they are purchased and the consumer usually returns the bottles in the same carrier. However, when a large quantity of beverage bottles are purchased, the handling thereof becomes difficult and it is also difficult to return the bottles when multiple carriers are involved. With the economic feasibility of disposable containers occurring, metal cans, such as aluminum, have been used to package beverages with the consumer normally purchasing a "six pack" and disposing of the wrapper or carrier and the containers after the beverages have been consumed. However, numerous jurisdictions have enacted ordinances or legislation requiring that a deposit be collected on normally throwaway containers when a consumer purchases the beverages so that when the containers are returned, a refund will be made thereby inducing the consumer to return the throwaway containers rather than throwing them onto areas adjacent roadways and the like which contributes to unsightliness and creates a disposal problem. While bulk recycling centers have been provided for recycling the aluminum cans, the ordinances or legislation usually requires that the beverage containers be returned intact, that is, without being broken or crushed in order to obtain the refund. The return of such containers presents a problem to consumers. For example, when paper bags are used, it is necessary to remove the containers from the bags in order to count them and in order to make sure that they are from the jurisdiction in which the purchase deposit was paid. Frequently, residual liquid is in the containers which runs out into the paper bags thus rendering them ineffective for retaining a plurality of containers. Various efforts have been made to provide carriers for returning beverage containers with such devices being exemplified by the following U.S. Pat. Nos.

1,975,428, Oct. 2, 1934
3,164,185, Jan. 5, 1965
3,311,294, Mar. 28, 1967
3,362,577, Jan. 9, 1968
4,193,525, Mar. 18, 1980
4,212,377, July 15, 1980
4,280,336, July 28, 1980
4,290,525, Sept. 22, 1981
4,299,324, Nov. 10, 1981

4,300,697, Nov. 17, 1981

SUMMARY OF THE INVENTION

An object of the present invention is to provide a flexible bag type carrier for beverage containers in the form of a generally rectangular, open topped, closed bottom bag in which the opposed side and end walls and bottom are constructed of flexible transparent vinyl material or the like with strap type handles attached to and projecting from the upper edges of opposed side walls to facilitate handling of the carrier with the interior of the bag being divided into a plurality of vertically disposed compartments for receiving a plurality of vertically disposed beverage containers therein.

Another object of the invention is to provide a carrier in accordance with the preceding objects in which the interior of the bag is provided with a plurality of dividers which are perpendicularly oriented in relation to each other to form a plurality of compartments with the dividers including interengaging half length slots which enables the dividers to be collapsed into a substantially flat condition with the bottom of the bag including a rigid panel which can be tilted to a vertical position to enable collapse of the bag into a compact condition for storage and transport when desired.

A further object of the invention is to provide a carrier in accordance with the preceding objects in which the dividers, bottom panel and end panels are constructed of substantially rigid cardboard material or the like with all of these components being removable and insertable when desired and being oriented in an extended position or collapsed position to facilitate handling of the carrier and enabling a substantially rigid carrier to be provided when the dividers, bottom and end panels are all in place thereby providing stable, vertically elongated compartments for a plurality of containers with the transparent wall enabling the containers to be observed for counting purposes with the rigid bottom providing a stable unit by which the carrier can be placed on a supporting surface with the interior components in the bag being retained therein even when the bag is inverted for dumping the containers from the compartments.

Still another object of the invention is to provide a carrier in accordance with the preceding objects which is simple in construction, inexpensive to manufacture and yet effective for carrying a plurality of beverage containers, especially empty beverage cans when they are being returned to the point of purchase for a refund of a purchase tax or deposit.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
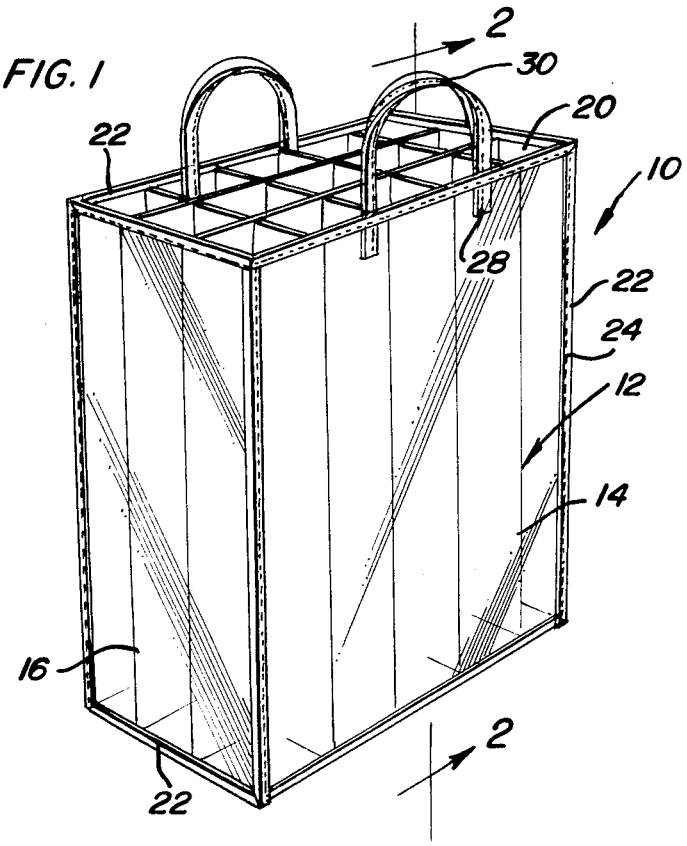
FIG. 1 is a perspective view of the flexible bag carrier of the present invention.
Figure 2:
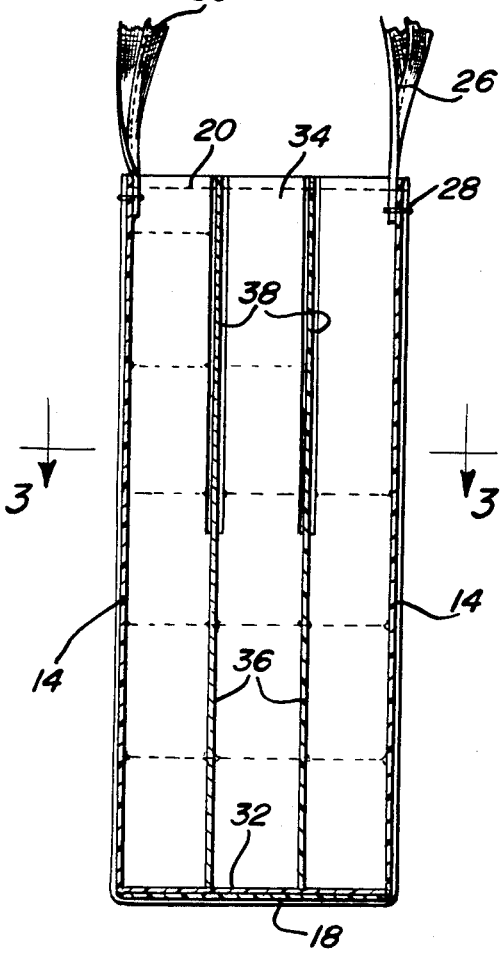
FIG. 2 is a vertical sectional view taken substantially upon a plane passing along section line 2—2 on FIG. 1 illustrating structural details of the carrier.

Referring now specifically to the drawings, the flexible bag type carrier of the present invention is generally designated by reference numeral 10 and includes a flexible, generally rectangular, open topped bag 12 which includes a peripheral wall defined by generally rectangular side walls 14 interconnected by generally rectangular end walls 16 having substantially less width than the side walls 14. A bottom wall 18 of generally rectangular configuration forms a closure for the bottom of the bag and the top of the bag is open as indicated by numeral 20. All of the panels 14, 16 and 18 are constructed of flexible heavy gauge see through soft vinyl plastic or equivalent material with the juncture between the panels and the top edge of the panels being secured by a binding tape 22 secured in place by stitching 24 with the tape at the juncture between the panels 16 and 14 being on the exterior of the bag with the side wall panels 14 and the bottom panel 18 being of continuous one piece material. Thus, the tape 22 projects outwardly along each corner of the bag and across the end corners thereof and the tape around the top edges of the panels 14 and 16 is partially interiorly of and partially exterior of the respective panel thus providing a binding tape peripherally of the bag.

The upper edge of each side wall 14 is provided with a U-shaped handle 26 of flexible material stitched to the side wall 14 at 28 with the handle 26 being a strip of the same vinyl material folded about its longitudinal center and secured in folded relation by a binding tape and stitching along the outer edge thereof as indicated by numeral 30 so that the handles 26 are flexible but yet have sufficient width so that they do not cut into and cause discomfort to the hands and fingers when the carrier is being carried.

Figure 4:
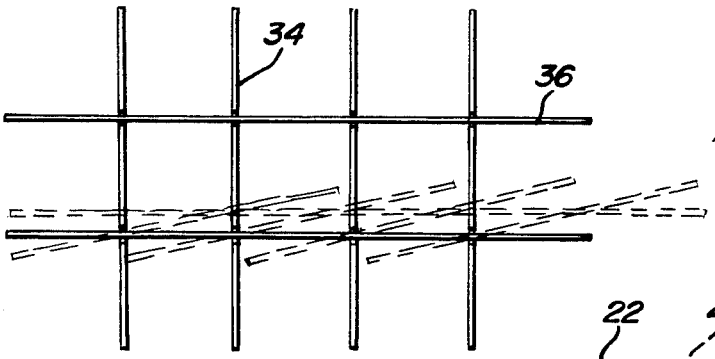
FIG. 4 is a fragmental plan view of the dividers per se illustrating the manner in which the dividers can be collapsed into a compact position.
Figure 3:
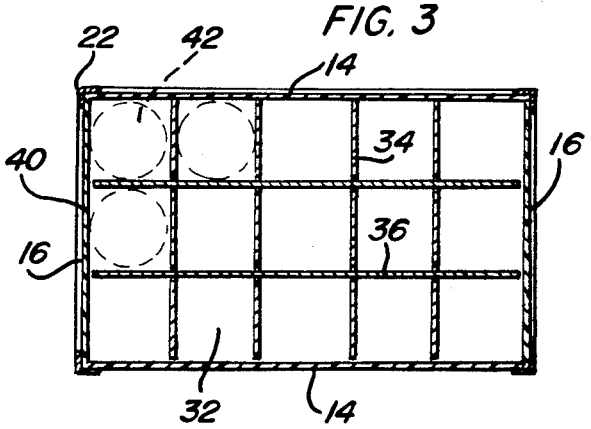
FIG. 3 is a transverse, plan sectional view taken substantially upon a plane passing along section line 3—3 on FIG. 2 illustrating further structural details of the carrier.

Disposed interiorly of the bag 12 is a rigid bottom liner 32 of cardboard or the like which closely fits the rectangular configuration of the bottom 18. Positioned interiorly and extending throughout the length of the bag 12 is a plurality of transverse dividers 34 and longitudinal dividers 36 which are of substantially rigid cardboard or the like and which may vary in number depending upon the size of the compartments desired. Each of the dividers 34 and 36 have a half length slot 38 formed therein from opposite ends so that the dividers 34 and 36 are interengaged with each other to enable these components to pivot in relation to each other into a folded condition as illustrated in broken line in FIG. 4. Each end wall 16 is provided with a liner 40 of the same shape and size as the end wall which retains the end wall straight and flat when the dividers 34 and 36 are oriented in perpendicular relation to each other thereby providing a stable unit. When the dividers are pivoted in the manner illustrated in FIG. 4, the end liners 40 may be positioned alongside of the folded dividers and the bottom liner 32 may be pivoted upwardly alongside of the folded dividers thereby enabling the flexible peripheral wall of the bag 12 to be folded into a compact condition for use of storage, transport and the like.

With this construction, the entire carrier may be constructed of inexpensive materials which are durable and long lasting and impervious to damage from residual liquids which may exist in the containers. A plurality of stacks of beverage cans 42 may be placed in the carrier with the containers being visible from the exterior thereof except for those which are in the interior compartments. However, by making the carrier and dividers constructed so that only two rows of compartments are provided, the exterior of all of the cans can be observed thereby enabling them to be counted and also enabling the indicia on the cans to be observed. While the carrier is especially adapted for use in returning beverage cans to the point of purchase for refund of a deposit, it can be used for carrying returnable bottles for refund of a deposit in the same manner. After the containers have been returned and deposit collected, the bag may be used for general purposes such as a shopping bag to carry groceries or other purchases or it may be used to carry full containers which have been purchased in less quantities than a six pack or the like. The exterior of the carrier provides space for advertising material, slogans, trademarks, logos, or other indicia. The dividers 34 and 36 may be retained in their perpendicular relation by friction type clips having perpendicularly arranged slots or they may be connected together by hinge tapes or other suitable structure to maintain them in assembled condition. The slot structure 38 enables easy assembly of the dividers and disassembly when desired with the structure of the bag 12 and the dividers being inexpensive and relatively easy to manufacture.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A reusable carrier for use in combination with a plurality of beverage cans of cylindrical configuration with flat ends in which the cans are of a identical size for stacking in a plurality of vertical stacks, said carrier comprising a generally rectangular bottom wall, a pair of generally rectangular sidewalls and a pair of generally rectangular end walls of less width than the sidewalls, said bottom wall and sidewalls being constructed from one piece of material, said end walls being secured to the end edges of the bottom wall and side edges of the sidewalls by tape reinforced seams, all of said walls and seams being of flexible transparent plastic material with the internal dimensions of the carrier spacing the walls apart a distance to receive a plurality of side-by-side stacks of beverage cans, the top edge of the sidewalls and end walls being reinforced by binding tape and being spaced from the bottom wall a distance to receive a plurality of vertically stacked cans, a loop handle in the form of a tape reinforced strip of flexible material secured centrally to the top edge of each sidewall, a substantially rigid bottom liner covering the interior of the bottom wall and resting on the upper surface thereof in unattached relation to enable the liner to be pivoted upwardly about one side edge thereof into a vertical position alongside one of said sidewalls, a plurality of transversely spaced, longitudinal dividers extending vertically from the liner and terminating in a straight upper edge flush with the top edge of the end walls, a plurality of longitudinally spaced, transverse dividers extending vertically from the liner and terminating in a straight upper edge flush with the top edge of the sidewalls, said dividers being of substantially rigid panel-like construction, said dividers being arranged in perpendicular relation to form a plurality of vertical extending compartments to closely receive stacks of can, said dividers including an inwardly extending slot extending from one end edge to a point just past the mid-length to enable sliding assembly and disassembly and relative movement to folded condition when the compartments are empty, and an end wall liner of substantially rigid construction engaging the inner surface of each end wall and generally coextensive therewith and being retained in place against the end wall by the end edges of the longitudinal dividers, said end wall liners, bottom liner and dividers being positionable alongside one sidewall when the carrier is empty whereby the flexibility of the components of the carrier enables the carrier to be collapsed into compact condition for storage and to enable the carrier to be used as a grocery bag, shopping bag and the like after the empty beverage cans have been returned to a collection point for refund of a deposit.

* * * * *